United States Patent [19]

Moorefield, II

[11] Patent Number: 4,664,131

[45] Date of Patent: May 12, 1987

[54] APPARATUS FOR TRANSPORTING, STORING AND BLENDING SMALL BALES OF TOBACCO

[75] Inventor: James F. Moorefield, II, Danville, Va.

[73] Assignee: Lorillard, Inc., New York, N.Y.

[21] Appl. No.: 810,427

[22] Filed: Dec. 18, 1985

[51] Int. Cl.[4] ..... A24B 1/00; A24B 3/08

[52] U.S. Cl. ..... 131/300; 131/290; 131/306; 432/500

[58] Field of Search ..... 131/300-306, 131/290; 432/500

[56] References Cited

U.S. PATENT DOCUMENTS

| | | | |
|---|---|---|---|
| 481,954 | 9/1892 | Jewel | 432/500 |
| 3,972,674 | 8/1976 | Harrell | 432/500 |
| 4,021,928 | 5/1977 | Johnson | 432/500 |
| 4,245,657 | 1/1981 | Jordan et al. | 432/500 |
| 4,466,450 | 8/1984 | Huszczo | 131/300 |
| 4,520,579 | 6/1985 | De Cloet et al. | 432/500 |

*Primary Examiner*—V. Millin
*Assistant Examiner*—H. Macey
*Attorney, Agent, or Firm*—Brumbaugh, Graves, Donohue & Raymond

[57] ABSTRACT

An arrangement for transporting, storing, and blending tobacco employs a plurality of ventilated containers, each containing bales of a designated grade of tobacco. Containers are stored side-by-side and stacked several containers high, and rows of stacked containers are placed back-to-back so that all of the doors face outwardly. Following storage, the containers with various grades of tobacco are moved to a blending conveyor belt, and bales from the various containers are combined on the belt to form moxules of tobacco of a desired blend.

19 Claims, 10 Drawing Figures

APPARATUS FOR TRANSPORTING, STORING AND BLENDING SMALL BALES OF TOBACCO

FIELD OF INVENTION

The present invention relates to an arrangement for transporting, storing, and blending small bales of tobacco, typically weighing 20 to 60 kg.

BACKGROUND OF THE INVENTION

Tobacco shipped from overseas to the United States is generally received in foreign burlap wrapped bales weighing about 20–60 kg. Each bale contains tobacco of a selected designation, that is, each individual bale contains tobacco of a specified type, grade, chemical composition, or other criteria. For the purposes of this application, bales of tobacco will be referred to as containing a specified "grade" of tobacco; however, it is to be understood that the term "grade" refers to any criteria applied in sorting the tobacco when packed in the bales.

Once received, the tobacco is stored in its original bale so as to retain its grade identity. It is necessary that the tobacco retain its grade identity during storage so that, in a later stage of processing, it can be selectively blended with other grades of tobacco in desired proportions.

Baled tobacco, which has been shipped from overseas by surface transportation, is received in the United States with a moisture content normally of 14–25% (wet basis). As the tobacco tends to seek equilibrium, it gives up moisture to the surrounding atmosphere. If the bales are not adequately ventilated, this moisture can condense on the surface of the tobacco, and microorganisms present in the tobacco will begin to grow, producing mold.

While the tobacco is in storage, it is necessary that inspections be made at regular intervals. Inspections are necessary to ascertain the condition of the tobacco with respect to mold and also with respect to tobacco beetle infestation. Periodically, it may be necessary to fumigate the areas of baled tobacco storage for control of beetles. It is therefore necessary that, while the bales are kept in the warehouse, they not be so densely stored as to prevent fumigation.

To provide the necessary ventilation, inspection, and infiltration spaces for fumigation, it is presently the practice in the industry to store palletized bales of tobacco on open storage racks in the warehouse. Alternatively, bales of tobacco are stored, in large stacks or bulks, on pallets or dunnage to provide air space under the bulk. These known storage methods are labor intensive both for transporting and storing the bales initially and for removing the bales for subsequent processing. Also, as the individual bales become soft due to humidity changes during the storage cycle, the bales may fall from their position on the pallets.

SUMMARY OF THE INVENTION

The present invention is an improved arrangement for transporting, storing, and blending small bales of tobacco.

Bales of tobacco are stored in containers, each with a pair of sidewalls, a back wall, a roof, a floor, and a front with at least one door. The back wall and front have ventilation openings and the floor is formed with a plurality of ventilation openings distributed over its surface area. Bales of a selected grade of tobacco are stored in the interior of each container.

Preferably, the floor is a grid structure of elongated spaced floor members and lateral cross-members that extend under the longitudinal members to provide support. In the preferred structure, the doors cover substantially all the surface area of the front, whereby the doors may be opened to provide an unencumbered access into the interior, and the sides and top of the containers are non-ventilating.

A container in accordance with the invention may be formed by modifying sea freight containers of the type now used to transport freight worldwide. Typically, these containers are built in sizes of 8'6×8'×20' or 8'6×8'×40' and the walls are formed by a plurality of vertical structural members, with thinner wall portions between the structural members. Such containers may be modified in accordance with the invention by removing all or part of the thin wall sections in the front and back walls, leaving the upright structural members. The existing flooring, however, is removed and replaced by a structure with ventilations across the entire surface, preferably a grid structure as described above.

Bales of tobacco may be loaded in the modified containers dockside, and remain in the containers during subsequent transportation, storage, and blending of the baled tobacco. When containers are loaded at dockside, bales of similar grade are stored in the same container. The bales may be loaded using conventional techniques of bulk loading by use of side clamp trucks. When 20 foot long containers are utilized, two of these containers will fit on a flatbed truck for over-the-road transport to a storage facility. When 40 foot containers are used, one container is positioned on a flatbed truck.

Upon arrival at a storage facility, the containers are removed from the truck and moved by a lift truck to the storage location. Preferably, fork slots are formed in the modified bottom to facilitate handling in this manner.

A preferred storage configuration in accordance with the invention employs stacking of containers. Each container includes a means for stacking another container on top of it so as to leave a space between the bottom ventilation openings and atmosphere. Containers are stacked two, three or up to seven or more high, back-to-back in double rows in order to allow for cross ventilation. The doors on the back-to-back groups of containers face outwardly to allow for the inspection of tobacco in any container at any time without moving the containers. In the event inspections reveal the need to reorient bales within a container, or to remove some of the bales, the containers can readily be unstacked by use of the lift truck which placed them originally.

A preferred arrangement for blending of the stored tobacco once again employs a plurality of containers in accordance with the invention, in which different containers have bales of selected grades of tobacco. The invention provides for cross blending of the various grades into a moxule, or blend, or grouping.

The blending arrangement includes an elongate conveyor for transporting bales of tobacco, and a plurality of containers disposed along the conveyor for selectively unloading bales from the various containers onto the conveyor.

In the preferred arrangement, containers are disposed on either side of the conveyor belt, and a trolley rail with a hoist is disposed on each side of the conveyor, over one row of containers, to remove empty containers and replace them with full containers.

Sufficient containers are positioned on either side of the conveyor belt so that the number of containers corresponds to the number of grades of tobacco to be blended, or any multiple thereof, to facilitate the blending of moxules. Pallets are moved along the conveyor belt past the various containers, and bales of the various grades are loaded onto each pallet to produce the desired ratio of leaf grades.

Bales may be removed from the containers manually to the sides of the conveyor belt, or the containers may be tipped by the use of a dumping mechanism, so that the bales slide out against a backstop. Alternatively, a portable conveyor belt may be used to transport bales out of the containers to the sides of the blending conveyor belt.

The present invention provides a ready means for separating bales of various grade tobaccos, and for storing the bales of selected grades in a manner so that they cannot become separated during storage. Each small bulk of 16,000–18,000 lbs. is properly ventilated during storage and movement of containers from trucks into the storage area, inspection and treatment of the tobacco during storage, and movement from the storage area to the blending area are all done with a minimum of handling.

The invention permits keeping ready track of inventory during storage. Following storage the containers of the presorted tobacco grades may readily be employed for blending of moxules. When storing the tobacco, storage warehouses are interchangeable, and the use of the storage warehouse is flexible because the containers provide a self-supporting device which can be stacked, and because no special permanent equipment or structures, such as racks, are necessary in the warehouse.

The invention allows for easy removal of contaminated tobacco, such as that which may have been damaged in shipment by water, oil, etc. Moreover, the invention provides a fire-protective enclosure, i.e., will inhibit the spread of a fire in case one or more containers are ignited. As noted above, the storage containers have ventilation openings in the front, back and bottom. However, the sides of the containers are non-ventilating, such that a fire cannot spread horizontally to adjacent containers. Moreover, a fire in any one container is prevented from spreading up or down, due to the fact that the roof of one container, and the roof of the container below, both are non-ventilating. The invention provides security from pilferage or other losses since the doors of the containers can readily be locked. Finally, the invention provides protection from casual or transient water, which may enter a warehouse due to storm damage, leaking pipes, or other sources.

For a better understanding of the invention, reference is made to the following detailed description of preferred embodiments, taken in conjunction with the drawings accompanying the application.

DETAILED DESCRIPTION OF PREFERRED EMBODIMENTS

Figure 1:
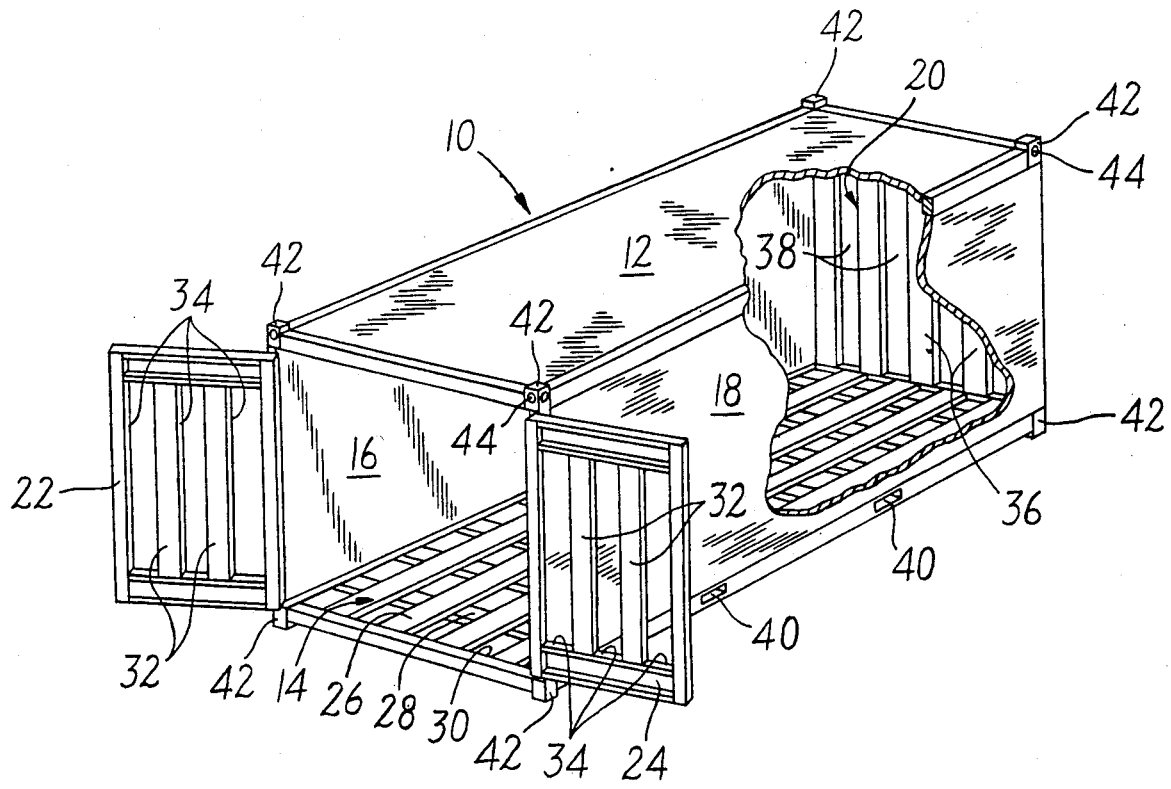
FIG. 1 is a schematic profile of a storage container in accordance with the invention.

A container 10 as shown in FIG. 1 includes a roof 12, a floor 14, sidewalls 16 and 18, a back wall 20, and a front, formed by two doors 22, 24. The floor 14 is a grid structure that includes a plurality of longitudinal structural members 26 supported by a plurality of structural cross-members 28 which define a plurality of ventilation openings 30 in the floor 14.

The doors 22 have plural upright structural members 32. Spaces 34 between the upright members 32 define ventilation openings. Similarly, the rear wall has upright structural members, 36 with spaces, e.g. 38 therebetween to provide rear ventilation openings. A pair of forklift openings 40 are formed in the floor 14, in a manner described below. Finally, end posts 42 are welded on to the corners of the structure. Posts of this type, which permit stacking of containers, are well known for use in seagoing containers. Holes 44 are provided to receive hooks (not shown) useable on hoist gear.

When containers are stacked one on top of the other, the posts 42 space the roof 12 of the lower container from the floor 14 of the container above it. As described further on, in a preferred storage configuration of the present invention, this space permits the bottom openings 30 to communicate with atmosphere for purpose of ventilating stored tobacco bales.

Figure 2:
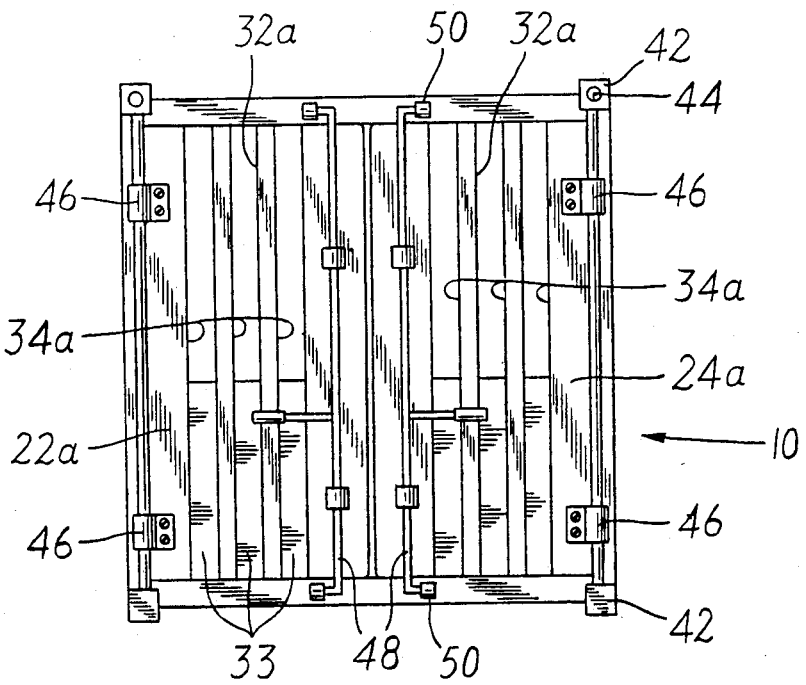
FIG. 2 is a front view of an exemplary container in accordance with the invention.

FIG. 2 shows a pair of doors 22A, 24A, of the type presently used in seagoing containers, but modified in accordance with the invention. Each door 22A, 24A has plural upright structural members 32A and a thin wall portion 33 that extends therebetween, in a corrugated type arrangement. Portions of the thin wall portion 33 have been removed, forming openings 34A for ventilation.

The doors, 22A, 24A are mounted in a known manner on the container by hinges 46, and by conventional closure rods 48, received in catches 50 in upper and lower portions of the frame. Each rod 48 includes a handle that may be readily locked to prevent access into the container.

Figure 3:
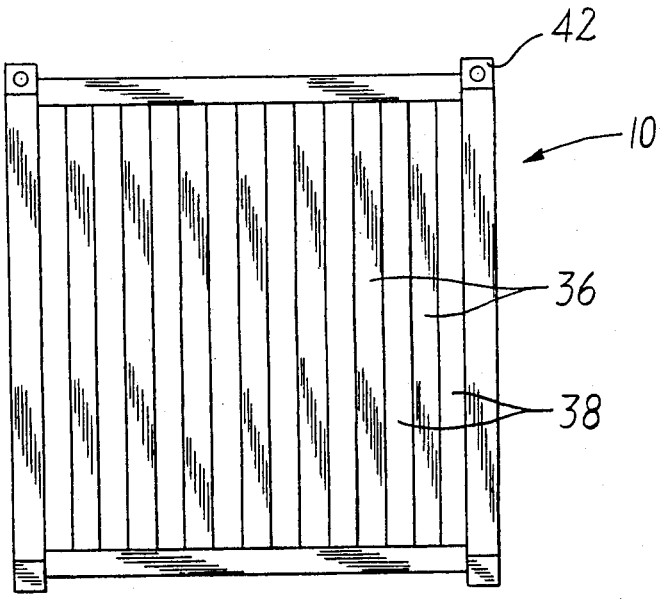
FIG. 3 is a rear view of an exemplary container in accordance with the invention.

FIG. 3 shows a rear portion of a conventional seagoing container, which has been modified by removing the thin walls from between the upright structural members 36. The resultant spaces 38 between the upright structural members 36 define openings for providing ventilation.

Figure 4:
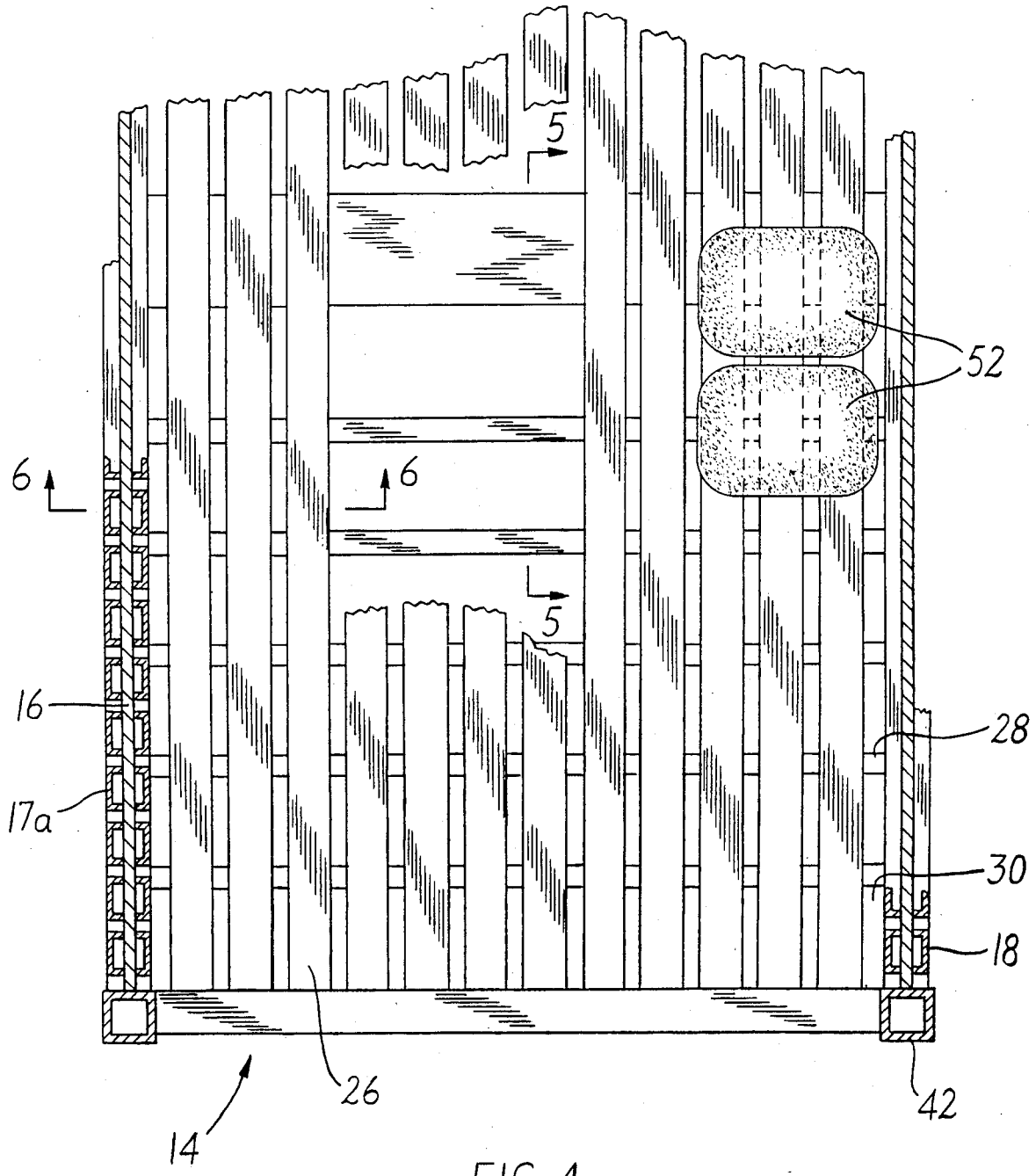
FIG. 4 is an enlarged top view of a flooring arrangement in accordance with the invention.
Figure 5:
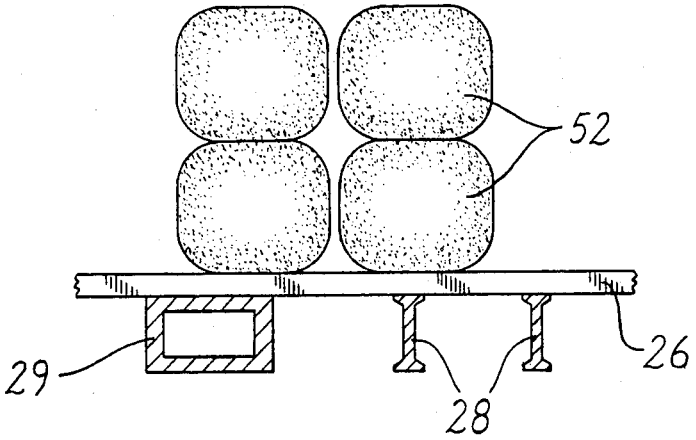
FIG. 5 is a sectional view, taken through lines 5—5 of FIG. 4.
Figure 6:
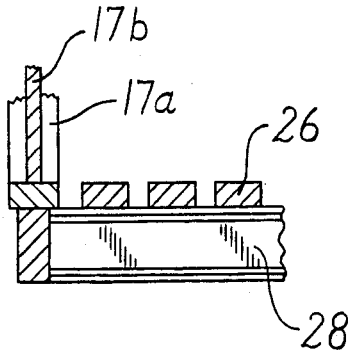
FIG. 6 is a sectional view taken through lines 6—6 of FIG. 4.

The bottom can be seen better by referring to FIGS. 4–6, which show the front portion of an exemplary bottom grid. Bales of tobacco 52 are stacked on the longitudinal support members 26, the latter being supported atop laterally extending I-bars 28 so as to define recesses 30 therebetween. The slatted floor formed thereby has ventilation openings over the entire floor surface area. FIG. 4 also illustrates the corrugated structure of the sidewalls 16, 18. As shown, a plurality of upright structural members 17A are welded on a thin wall portion 17B. Such structure is well known.

Referring to FIG. 5 it will be seen that one of the cross-pieces 29 is in the shape of a hollow rectangle. Cross-piece 29 corresponds to one of the recesses 40 for receiving the fork of a forklift truck, the distal ends of cross-piece 29 forming one of the openings 40. A second rectangular cross member 29 is disposed in a portion of the flooring, not shown in FIG. 4, corresponding in location to the second opening 40 shown in FIG. 1.

Figure 7:
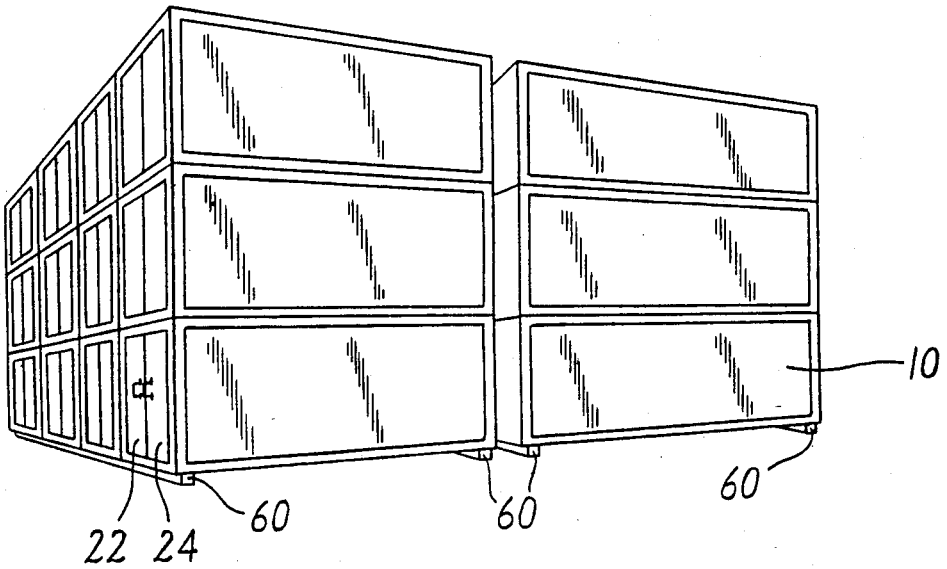
FIG. 7 is a schematic profile of a storage configuration in accordance with the invention.

FIG. 7 shows schematically a configuration for storing containers in accordance with the invention, in which containers 10 are stacked in two back-to-back rows. Each row is stacked three containers high, and four containers side-by-side. The groups are arranged back-to-back so that the doors 22, 24 of all the containers 10 face outwardly. Three high, and four wide stacking is merely illustrative. Fork lift trucks are available that will stack containers up to seven or more high; the number of containers to be placed side-by-side is arbitrary.

Although not depicted in FIG. 7, the end posts 42 provide a space between the roof of each container and the container stacked above it, and between the lowest container and the floor, to permit air to enter and circulate through the floor openings 30. Since the containers are back-to-back, circulating air may readily flow longitudinally through each back-to-back pair of containers. Lateral airflow, and vertical airflow between stacked containers, does not occur due to the non-ventilating sidewalls and non-ventilating roof in each container. Accordingly, if a fire should start in one container, the lateral sidewalls of the container prevent its spread horizontally to adjacent containers, the roof of the container prevents its spread upwardly; and the roof of the container below it prevents the spread downwardly.

Figure 10:
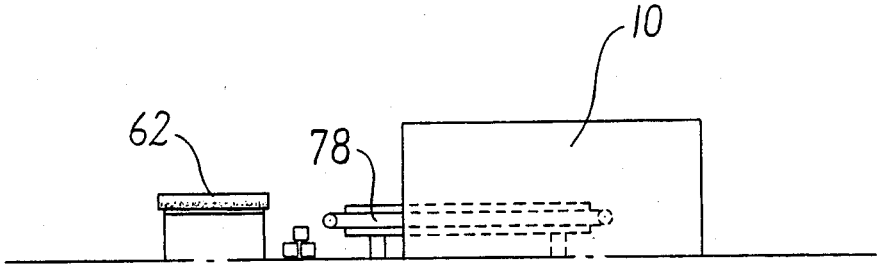
FIG. 10 is a side, schematic view of an alternative device for unloading containers for use in the arrangement of FIG. 8.

As shown in FIG. 10, if desired, slats 60 may be placed under the front and back ends of the bottom containers to further raise the container from the floor. Such may be desirable to enhance circulation as well as to help protect the tobacco bales in the bottom containers from damage due to flooding.

Figure 8:
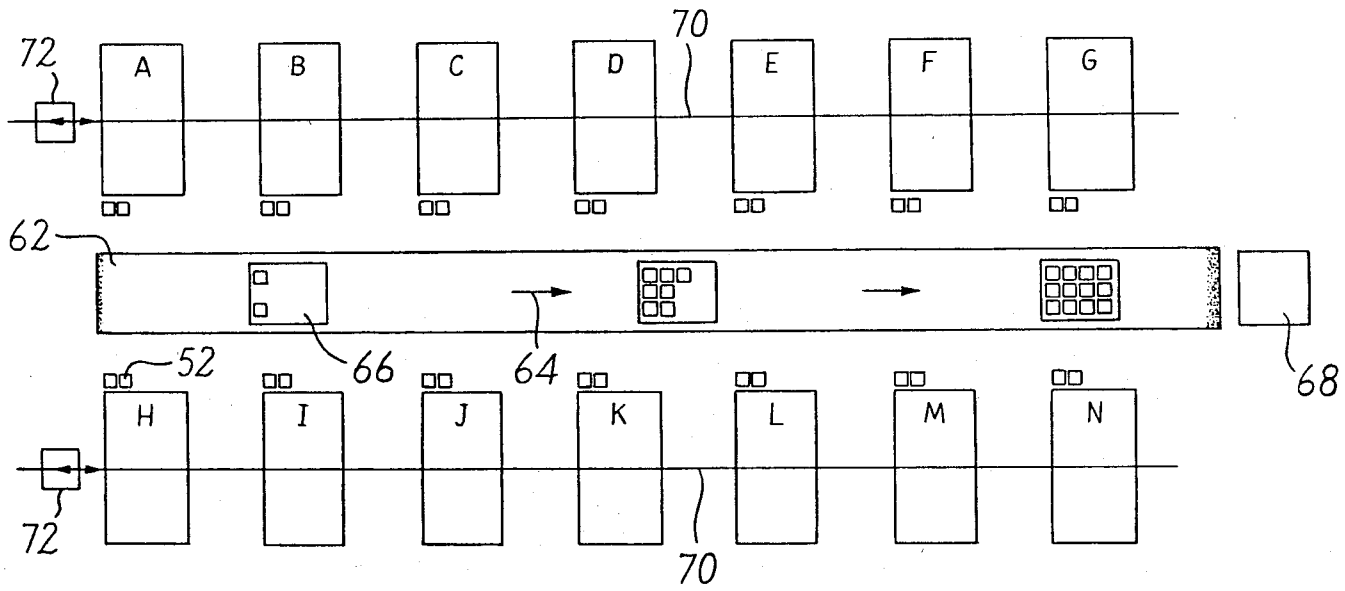
FIG. 8 is a top schematic view of a arrangement for blending tobacco in accordance with the invention.

FIG. 8 shows an arrangement for blending moxules of selected grades of tobacco. In the arrangement shown in FIG. 8, a plurality of containers, labelled A through N, are disposed on either side of a blending conveyor belt 62, which moves in the direction of arrow 64. Bales 52 of tobacco are unloaded from each of the containers A through N and available to be loaded on a blending pallet 66. Each of the containers A through N contains tobacco of a designated grade and as the pallets 66 move toward the terminal loading station 68, bales of various grades, from the containers A through N, are placed on the pallet in the desired proportion.

Trolley rails 70 are disposed to either side of the blending conveyor belt 62, and each includes a hoist 72 moveable along the rail and positionable over a selected container. When any of the containers are empty and require replacing, the hoist 72 is moved to lift the empty container, and thereafter replace it with a full container. The holes 44 in end posts 42 may readily be employed to engage the hoist ropes.

Figure 9:
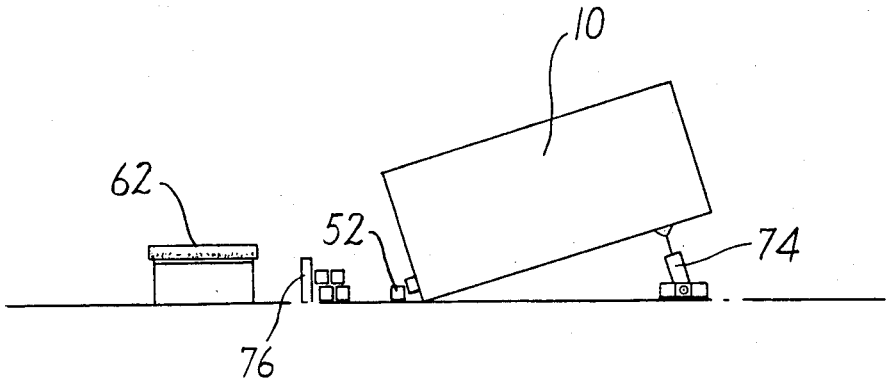
FIG. 9 is a side, schematic view of a device for unloading containers for use in the arrangement of FIG. 8.

To remove bales from the containers, the containers may be tipped by use of a dumping mechanism 74 such as shown in FIG. 9. Bales 52 dumped from the tilted containers 10 slide or roll against the backstop 76 located adjacent the conveyor belt 62. Alternatively, as shown in Fig. 10, a portable conveyor 78 may be positioned to move bales from the interior of the container to the side of the blending conveyor belt 62. The completed moxules are removed from the station 68 by lift trucks and stored or loaded on trucks for distribution to various manufacturing plants.

The foregoing represents preferred embodiments of the invention. Variations of the aforesaid structure and methods will be apparent to persons skilled in the art without departing from the inventive concepts disclosed herein. All such modifications and variations are intended to be within the scope of the present invention as defined in the following claims.

I claim:

1. Apparatus for transporting and storing small bales of tobacco comprising:

a container having opposed sidewalls, a back wall, a roof, a floor, and a front including at least one door, said walls, roof, floor, and front defining an interior, wherein said back wall and front have ventilation openings therein, and wherein said floor is formed with a plurality of ventilation openings distributed over its surface area; and a plurality of bales of tobacco stored in said interior.

2. Apparatus as defined in claim 1, wherein said floor is formed by a plurality of elongated floor members spaced to define said ventilation openings.

3. Apparatus as defined in claim 2, wherein said elongated floor members extend longitudinally from front to back, and said floor further comprises a plurality of lateral cross-members extending under said elongated floor members.

4. Apparatus as defined in claim 3, wherein a pair of said cross-members each defines a rectangular opening for receiving a fork of a forklift.

5. Apparatus as defined in claim 3, wherein said sidewalls and roof are non-ventilating.

6. Apparatus as defined in claim 3, wherein said at least one door covers substantially all the surface area of the front, whereby when the doors are open the container is open in the front.

7. Apparatus as defined in claim 3, wherein said front and back wall each have a plurality of spaced elongate members defining said openings therebetween.

8. Apparatus for storing bales of tobacco employing a plurality of containers as defined in claim 1, wherein each container includes means for stacking another container on top of it and for leaving space between the floor of one container and the roof of the container below it, thereby to permit the ventilation openings in the floor to communicate with atmosphere, wherein said containers are arranged side-by-side and stacked.

9. Apparatus as defined in claim 8, wherein said containers are disposed in a first row of side-by-side stacked containers, and a second row of side-by-side stacked containers, the first and second rows being back-to-back so that doors of all containers face outwardly.

10. Apparatus as defined in claim 9, wherein each container includes bales of tobacco of a selected grade.

11. Apparatus as defined in claim 8, wherein each container includes bales of tobacco of a selected grade.

12. Apparatus for cross-blending various grades of tobacco into a moxule employing a plurality of containers as defined in claim 1, including an elongate blending conveyor means for transporting bales of tobacco, and a plurality of containers, each containing bales of a designated grade of tobacco, disposed along said blending conveyor means for selectively unloading bales from various containers onto the blending conveyor means.

13. Apparatus as defined in claim 12, further including hoist means adjacent said blending conveyor means for removing empty containers and replacing said containers with new ones.

14. Apparatus as defined in claim 12, further comprising means associated with said containers for tilting the containers back-to-front toward said blending conveyor means to facilitate removal of bales from the containers.

15. A method of storing small bales of tobacco of various grades, comprising the steps of:

providing a plurality of containers, each container having opposed sidewalls, a back wall, a roof, a floor, and a front including at least one door, said walls, roof, floor and front defining an interior, wherein said back wall and front have ventilation openings therein, and wherein said floor is formed with a plurality of ventilation openings distributed over its surface area;

loading bales of selected grades of tobacco into selected containers; and storing said containers such that the ventilation openings in said floor communicate with atmosphere.

16. A method as defined in claim 15, wherein the storing step includes stacking containers into a first row of side-by-side stacks, a second row of side-by-side stacks, and arranging the first and second rows back-to-back so that the doors of each container face outwardly.

17. A method as defined in claim 15, further comprising the steps of moving a plurality of containers to be adjacent to a conveyor means, and combining on said conveyor means bales of tobacco from various containers, representative of selected grades of tobacco, to form a moxule of a selected ratio of tobacco grades.

18. A method as defined in claim 17, comprising the further step of selectively hoisting empty containers, and removing the same from adjacent the conveyor means, and replacing via a hoist the empty containers with full containers.

19. A method as defined in claim 17, comprising the step of tilting conveyors toward the blending conveyor means for dumping stored bales of tobacco.

* * * * *